United States Patent [19]

Itabashi et al.

[11] Patent Number: 4,758,547

[45] Date of Patent: Jul. 19, 1988

[54] HEAT-SENSITIVE RECORDING MATERIAL

[75] Inventors: Yuichi Itabashi; Akihiro Shimomura; Noriyuki Hosoi, all of Shizuoka, Japan

[73] Assignee: Fuji Photo Film Co., Ltd., Kanagawa, Japan

[21] Appl. No.: 902,831

[22] Filed: Sep. 2, 1986

[30] Foreign Application Priority Data

Sep. 2, 1985 [JP] Japan ..... 60-193667

[51] Int. Cl.[4] ..... B41M 5/18

[52] U.S. Cl. ..... 503/207; 427/152; 428/446; 428/457; 428/514; 428/522; 503/200; 503/226

[58] Field of Search ..... 346/200, 226; 427/150–152; 503/200, 226, 207; 428/446, 457, 514, 522

[56] References Cited

U.S. PATENT DOCUMENTS 4,583,103 4/1986 Hayashi et al. ..... 346/200
4,594,269 6/1986 Miyauchi et al. ..... 346/226

FOREIGN PATENT DOCUMENTS 0193189 11/1983 Japan ..... 346/200
0045191 3/1984 Japan ..... 346/200
6708184 4/1984 Japan ..... 503/226

*Primary Examiner*—Bruce H. Hess
*Attorney, Agent, or Firm*—Sughrue, Mion, Zinn, Macpeak, and Seas

[57] ABSTRACT

A novel heat-sensitive recording material is provided comprising a support, a heat-sensitive coloring layer containing an electron donating dye precursor which is normally colorless or light-colored and an electron accepting compound which exhibits a color upon reaction with said dye precursor, a first protective layer containing a polyvinyl alcohol resin and a second protective layer containing a silicon-containing denaturated polyvinyl alcohol, a colloidal silica and/or amorphous silica, wherein either of the first or second protective layer may be coated directly on said coloring layer.

9 Claims, No Drawings

HEAT-SENSITIVE RECORDING MATERIAL

FIELD OF THE INVENTION

The present invention relates to a heat-sensitive recording material. More particularly, the present invention relates to a heat-sensitive recording material which uses the coloring reaction of a dye precursor which is normally colorless or light-colored and a compound which exhibits a color upon reaction with the dye precursor (hereinafter referred to as "developable compound").

BACKGROUND OF THE INVENTION

A so-called binary heat-senstive recording material which utilizes a coloring reaction of a colorless or light-colored dye precursor and a developable compound is disclosed in Japanese Patent Publication Nos. 14039/70 and 4160/68 and Japanese Patent Application (OPI) No. 190886/84 (the term "OPI" as used herein means an "unexamined published application"). Such a binary heat-sensitive recording material has the following practical advantages: (1) it uses primary coloring and thus needs no development; (2) its paper quality is close to that of commonly used paper; (3) it can be easily handled; (4) it can provide a high color density; and (5) it can provide various hues. Therefore, such a binary heat-sensitive recording material is widely used as a heat-sensitive recording material.

In recent years, such a heat-sensitive recording material has been widely used in the printing of bar code labels for sales point data control systems as well as in facsimiles, recorders, and printers.

On the other hand, since such a heat-sensitive recording material utilizes primary coloring, it is disadvantageous in that it undergoes reaction between a dye precursor and a developable compound due not only to application of heat but also upon contact with solvents or the like. This is because such a heat-sensitive recording material comprises organic materials which are highly soluble in solvents and readily react in the solvents. Accordingly, when the heat-sensitive recording material is brought into contact with a stationery containing solvents such as an aqueous or oil ink pen, a fluorescent pen, adhesive, or a plasticizer contained in cooking oil, and wrap film for packaging foods, its background can be colored or its printed portions can be discolored, marring the commercial value.

Efforts have been made in order to eliminate these disadvantages. For example, a protective layer which is resistant to solvents is provided on a heat-sensitive coloring layer as disclosed in Japanese Patent Publication No. 27880/69 and Japanese Patent Application (OPI) Nos. 30437/73 and 31958/73.

In other attempts, two protective layers are provided in order to improve the effectiveness of the various resistances, as disclosed in Japanese Patent Application (OPI) No. 67081/84.

Adhesives such as polyvinyl alcohol and denaturated polyvinyl alcohol have been used as materials for such a protective layer. However, a protective layer provided by laminating two polyvinyl alcohol layers has an insufficient water resistance. Also, a protective layer provided by laminating two layers containing a silicon-containing denaturated polyvinyl alcohol and a colloidal silica has an insufficient resistance to oil. Furthermore, a protective layer provided by laminating a layer of polyvinyl alcohol and a layer of another water-soluble polymer has an insufficient water resistance. Thus, protective layers provided only by laminating unit protective layers have insufficient resistance to various chemicals, water and oil, provide a lower sensitivity, show a poor anti-sticking property, and undergo blocking. Such protective layers also require a complicated production process and thus production costs are relatively high. Therefore, the prior art heat-sensitive recording materials cannot fully satisfy all of the above-noted industrial requirements.

SUMMARY OF THE INVENTION

It is therefore an object of the present invention to provide a heat-sensitive recording paper which provides an excellent print density, exhibits resistance to various chemicals, oil and water, has good anti-sticking and anti-blocking properties, and is industrially advantageous.

The above and other objects of the present invention will be more apparent from the following detailed description of the invention and examples.

These objects of the present invention are accomplished by a heat-sensitive recording material comprising a support having provided thereon a heat-sensitive coloring layer containing an electron donating dye precursor which is normally colorless or light-colored, and further containing an electron accepting compound which exhibits a color upon reaction with the dye precursor, wherein the coloring layer is laminated with a first protective layer containing a polyvinyl alcohol-based resin and a second protective layer containing a silicon-containing denatured polyvinyl alcohol, a colloidal silica and/or amorphous silica. In the present invention, the arrangement of the two protective layers is not specifically limited, but the polyvinyl alcohol layer is preferably laminated under the other protective layer.

DETAILED DESCRIPTION OF THE INVENTION

The polymerization degree of the polyvinyl alcohol to be used in the present invention is not specifically limited but is preferably about 1,000 or more. The saponification degree of the polyvinyl alcohol is preferably about 86% or more. The polyvinyl alcohol may be used in combination with a conventional waterproofing agent capable of waterproofing it.

Examples of such a waterproofing agent are described in, for example, *Poval* (edited by Koichi Nagano et al., published by KOBUNSHI KANKOKAI, 1981) and *Polyvinyl Alcohol* (edited by Ichiro Sakurada, published by KOBUNSHI GAKKAI, 1956).

The first protective layer comprising polyvinyl alcohol of the present invention may also contain other polymers.

Examples of such polymers which may be used in combination with polyvinyl alcohol include water-soluble high molecular weight compounds such as methyl cellulose, carboxy methyl cellulose, hydroxy methyl cellulose, starch, gelatin, gum arabic, casein, styrene-maleic anhydride copolymer hydrolyzate, styrene-maleic anhydride copolymer half ester hydrolyzate, isobutylene-maleic anhydride copolymer hydrolyzate, silica denatured polyvinyl alcohol, carboxy-denaturated polyvinyl alcohol, polyacrylamide derivatives, polyvinyl pyrrolidone, sodium polystyrenesulfonate, and sodium alginate, as well as water-insoluble polymers such as styrene-butadiene rubber latex, acrylonitrile-butadiene rubber latex, methyl acrylate-butadiene rubber latex, and vinyl acetate emulsion, etc.

The silicon-containing denatured polyvinyl alcohol which may be used in the second protective layer of the present invention is not specifically limited as long as it contains silicon atoms in its molecule. In general, silicon-containing polyvinyl alcohols having reactive substituent groups such as an alkoxyl group, an acyloxyl group or a hydroxyl group obtained by hydrolysis or the like or an alkali metal salt thereof are preferred.

The details of a process for the preparation of such a silicon-containing denaturated polyvinyl alcohol are described in Japanese Patent Application (OPI) No. 193189/83. The silicon-containing denaturated polyvinyl alcohol which may be used in the present invention can be prepared by these known processes.

A summary of these known processes is described hereinafter. However, the process for the preparation of the denaturated polyvinyl alcohol which may be used in the present invention is not limited to the processes described in the above-mentioned patent application but may be accomplished by other processes.

(a) Incorporation of silicon atoms into a polyvinyl alcohol or a denaturated vinyl polyacetate containing carboxy groups or hydroxyl groups by conversion using a silylating agent.

(b) Saponification of a copolymer of a vinyl ester and an olefinic unsaturated monomer containing silicon atoms.

The process (a) can be accomplished by, for example, the following steps:

A silylating agent is dissolved in an organic solvent having no reactivity with said silylating agent. A polyvinyl alcohol or a denaturated vinyl polyacetate containing carboxyl groups or hydroxyl groups is suspended in the resulting solution. The resulting suspension is then heated to a temperature between room temperature and the boiling point of the silyating agent so that the polyvinyl alcohol or denaturated vinyl polyacetate reacts with the silylating agent. The vinyl polyacetate is optionally further saponified by an alkali catalyst. Thus, a silicon-containing denaturated polyvinyl alcohol is obtained.

Examples of silylating agents which may be used in this process include organohalogen silane, organosilicon ester, organoalkoxy silane, organosilanol, aminoalkyl silane, organosilicon isocyanate and so on. The amount of silylating agent to be incorporated into the system or conversion may be properly adjusted by altering the amount of the silylating agent and the reaction time.

Also, the process (b) can be accomplished by, for example, the following steps:

A vinyl ester and an olefinic unsaturated monomer containing silicon atoms are copolymerized with each other in the presence of a radical initiator in an alcohol. An alkali or an acid catalyst is added to the resulting alcohol solution of copolymer so that the copolymer is saponified to obtain a silicon-containing denaturated polyvinyl alcohol.

Examples of vinyl esters which may be used in the present invention include vinyl acetate and vinyl propionate, etc. For economical reasons, however, vinyl acetate is preferably used. Examples of the olefinic unsaturated monomers containing silicon atoms which may be used in the present invention include vinyl silanes represented by the general formula (I) and (meth)acrylamide-alkyl silanes represented by the general formula (II).

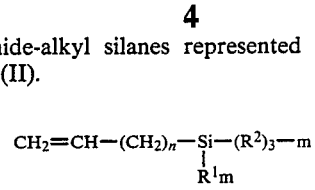

$$CH_2{=}CH{-}(CH_2)_n{-}\underset{\underset{R^1m}{|}}{Si}{-}(R^2)_3{-}m \quad (I)$$

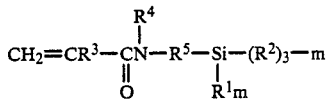

$$CH_2{=}CR^3{-}\overset{\overset{R^4}{|}}{\underset{\underset{O}{\|}}{C}}N{-}R^5{-}\underset{\underset{R^1m}{|}}{Si}{-}(R^2)_3{-}m \quad (II)$$

wherein n represents an integer of 0 to 4; m represents an integer of 0 to 2; $R^1$ represents a $C_{1-5}$ alkyl group; $R^2$ represents a $C_{1-40}$ alkoxy group or acyloxy group which may have substituent groups containing oxygen atoms; $R^3$ represents a hydrogen atom or methyl group; and $R^4$ represents a hydrogen atom, $C_{1-5}$ alkylene group or a divalent organic residual group having chain carbon atoms connected mutually by oxygen or nitrogen atoms, with the proviso that when two or more of $R^1$ are contained in the same monomer, they may be either the same or different and that when two or more of $R^2$ are contained in the same monomer, they may be either the same or different.

Specific examples of the vinyl silanes represented by the general formula (I) include vinyl trimethoxy silane, vinyl triethoxy silane, vinyl tris-(β-methoxyethoxy)silane, vinyl triacetoxy silane, allyl trimethoxy silane, allyl triacetoxy silane, vinyl methoxy diacetoxy silane, vinyl dimethoxy methyl silane, vinyl dimethyl ethoxy silane, vinyl methyl diacetoxy silane, vinyl diemthyl acetoxy silane, vinyl isobutyl diemthoxy silane, vinyl triisopropoxy silane, vinyl tributoxy silane, vinyl trihexyloxy silane, vinyl methoxy dihexyloxy silane, vinyl-trioctyloxy silane, vinyl dimethoxy octyloxy silane, vinyl methoxy dioctyloxy silane, vinyl methoxy dilauryloxy silane, vinyl dimethoxy lauryloxy silane, vinyl methoxy dioleiloxy silane, vinyl dimethoxy oleiloxy silane, polyethylene glycolated vinyl silanes represented by general formula (III):

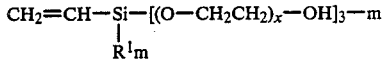

$$CH_2{=}CH{-}\underset{\underset{R^1m}{|}}{Si}{-}[(O{-}CH_2CH_2)_x{-}OH]_3{-}m \quad (III)$$

wherein $R^1$ and m are as defined above with respect to general formula (I) and (II); and x represents an integer of 1 to 20, etc.

Specific examples of the (meth)acrylamidealkyl silanes represented by the general formula (II) include 3-(meth)acrylamide-propyltrimethoxy silane, 3-(meth)acrylamide-propyltriethoxy silane, 3-(meth)acrylamide-propyltri(β-methoxy)silane, 2-(meth)acrylamide-2-methylpropyl trimethoxy silane, 2-(meth)acrylamide-2-methylethyltrimethoxy silane, N-(2-(meth)acrylamide-ethyl)-aminopropyltrimethoxy silane, 3-(meth)acrylamide-propyltriacetoxy silane, 2-(meth)acrylamide-ethyltrimethoxy silane, 1-(meth)acrylamide-methyltrimethoxy silane, 3-(meth)acrylamide-propylmethyl dimethoxy silane, 3-(meth)acrylamide-propyldimethyl methoxy silane, 3-(N-methyl-(meth)acrylamide)-propyltrimethoxy silane, etc.

In the process of preparation of the present silicon-atom containing denaturated polyvinyl alcohol, these silanes may be used singly or in combination. Furthermore, in the process of copolymerization of a vinyl ester and an olefinic unsaturated monomer containing silicon atoms, other unsaturated monomers copolymerizable with such a monomer may be present besides the above two components.

Preferred silicon-containing denaturated polyvinyl alcohols may be prepared by the above-mentioned processes, particularly saponified products of copolymers of silicon atom-containing olefinic unsaturated monomers represented by general formula (I) prepared by the process (b) described above and vinyl acetate. More preferred are saponified products of copolymers of vinyl trimethoxy silane and/or vinyl tributoxy silane represented by general formula (I) and vinyl acetate.

The silicon atom content of the silicon-containing denaturated polyvinyl alcohol thus prepared may be properly selected depending on the type of application but should be generally about 0.01 to about 10 mol.%, preferably 0.1 to 2.5 mol.%, calculated in terms of the olefinic unsaturated monomer unit containing silicon atoms.

The polymerization degree of the silicon-containing denatured polyvinyl alcohol is not specifically limited but should be generally about 250 to about 3,000, preferably 300 to 2,000, and more preferably 500 to 2,000. Similarly, the saponification degree of the denaturated polyvinyl alcohol as a vinyl acetate unit is not specically limited but is preferably in the range of about 70 to about 100%.

The colloidal silica and/or amorphous silica which may be used in combination with the silicon-containing denaturated polyvinyl alcohol in the present invention are obtained by industrial production. The colloidal silica is a colloidal solution comprising ultrafine silicic acid anhydride dispersed in water as a dispersant. The particle size of the ultrafine silicic anhydride is preferably about 10 to about 100 mμ with a specific grainty of 1.1 to 1.3. In this case, the pH value of the colloidal solution is preferably about 4 to about 10.

The amorphous silica may be industrially prepared by a wet process or a gas phase process. The amorphous silica which may be used in the present invention preferably has a primary particle diameter of about 10 to about 30 nm, a secondary particle diameter of about 0.5 to 10 μm, an oil absorption (determined in accordance with JIS K 5101 (established 1978)) of about 150 to about 300 ml/100 g, an apparent specific gravity (determined in accordance with JIS K 6223 (established 1976)) of about 0.1 to about 0.3 g/ml and a pH (determined in the form of 5% by weight suspension) of about 6 to about 10.

The above-mentioned silicon-containing denaturated polyvinyl alcohol and colloidal silica and/or amorphous silica may be mixed with each other in a proper proportion before being applied to a heat-sensitive coloring layer as a protective layer.

The suitable mixing proportion of the silicon-containing denaturated polyvinyl alcohol and colloidal silica and/or amorphous silica is about 1 part: about 0.05 to about 10 parts by weight, preferably 1 part: 0.1 to 5 parts by weight, and most preferably 1 part: 0.2 to 2 parts by weight.

When the applied amount of the protective layer is smaller, the resistance of the heat-sensitive recording material to various chemicals, which is one of the objects of the present invention, becomes low. When the applied amount of the protective layer is larger, the heat response of the heat-sensitive coloring layer is poor. Accordingly, the applied amount of the protective layer may be determined in accordance with both of these requirements.

Furthermore, binders which have heretofore been commonly used may be used in combination with these silica. Examples of such binders include polyvinyl alcohol, methyl cellulose, starch, carboxymethyl cellulose, styrene-maleic acid copolymer, diisobutylenemaleic acid copolymer, polyamide resin, polyacrylamide resin, etc.

Examples of the colorless or light-colored electron donating dye precursors to be used for the present heat-sensitive coloring layer include triaryl methane compounds diphenyl methane compounds, xanthene compounds, thiazine compounds, spiropyrane compounds, diazo compounds, etc. Specific examples of these compounds include those described in Japanese Patent Applciation (OPI) No. 27253/80.

Specific examples of such triaryl methane compounds include 3,3-bis(p-dimethylaminophenyl)-6-dimethylaminophthalide (i.e., crystal violet lactone), 3,3-bis(p-dimethylaminophenyl)phthalide, 3-(p-dimethylaminophenyl)-3-)1,3-dimethylindole-3-yl(phthalide, and 3-(p-dimethylaminophenyl)-3-(2-methylindole-3-yl)phthalide, etc. Specific examples of such diphenyl methane compounds include 4,4'-bisdimethyl amino benzhydrine benzyl ether, N-halophenylleuco Auramine, and N-2,4,5-trichlorophenyl leuco Auramine, etc. Specific examples of such xanthene compounds include Phodamine-B-anilino lactam, Rhodamine(p-nitrino)lactam, 2-(dibenzylamino)fluorane, 2-phenylamino-6-diethylamino-fluorane, 2-(o-chloroanilino)-6-diethylamino fluorane, 2-(3,4-dichloroanilino)-6-diethylamino fluorane, 2-anilino-3-methyl-6-piperidino fluorane, 2-phenyl-6-diethylamino fluorane, etc. Specific examples of such spiro compounds include 3-methyl-spiro-dinaphthopyrane, 3-ethyl-spiro-dinaphthopyrane, 3,3'dichloro-spiro-dinaphthopyrane, 3-benzylspiro-dinaphthopyrane, 3-methyl-naphtho-(3-methoxy-benzo)-spiropyrane, 3-propyl-spiro-dibenzopyrane, etc. These compounds may be used singly or in admixture.

The diazo compound to be used in the present invention may be a diazonium salt represented by the general formula $ArN_2{+}X^-$ which is a compound capable of coloring upon a coupling reaction with a coupling component or decomposing by light. (In the above general formula, Ar represents a substituted or unsubstituted aromatic portion, $N_2{+}$ represents a diazonuim group, and $X^-$ represents an acid anion.)

Specific examples of the diazonium compounds forming salts include 4-diazo-1-dimethylaminobenzene, 4-diazo-1-diethylamino-benzene, 4-diazo-1-dipropylaminobenzene, 4-diazo-1-methylbenzylaminobenzene, 4-diazo-1-dibenzylaminobenzene, 4-diazo-1-ethylhydroxy-ethylaminobenzene, 4-diazo-1-diethylamino-3-methoxy benzene, 4-diazo-1-dimethylamino-2-methylbenzene, 4-diazo-1-benzoylamino-2,5-diethoxybenzene, 4-diazo-1-morpholinobenzene, 4-diazo-1-morpholino-2,5-diethoxybenzene, 4-diazo-1-morpholino-2,5-dibutoxybenzene, 4-diazo-1-anilinobenzene, 4-diazo-1-tolymercapto-2,5-diethoxybenzene, 4-diazo-1,4-methoxybenzoylamino-2,5-diethoxybenzene, etc.

Specific examples of such an acid anion include compounds represented by the following formulae: (1) $C_nF_{2n+1}COO^-$, wherein n represents an integer of 3 to 9; (2) $C_mF_{2m+1}SO_3^-$, wherein m represents an integer of 2 to 8; (3) $(C_lF_{2l+1}SO_2)_2CH^-$ wherein l represents an integer of 1 to 18, as well as the following compounds:

A-1

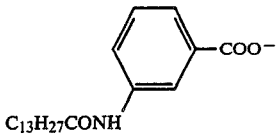

A-2

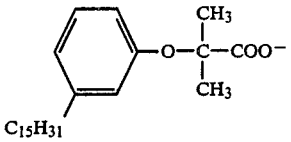

A-3

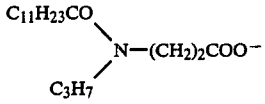

A-4

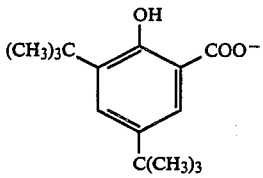

A-5

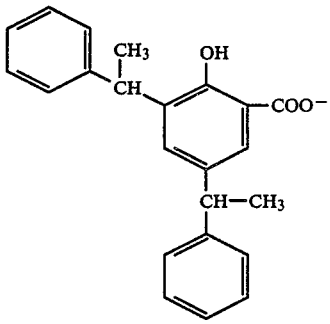

$BF_4^-$, and $PF_6^-$, etc.

Preferred electron accepting compounds to be used for the present heat-sensitive coloring layer are represented by the general formulae (IV) to (VIII):

(IV)

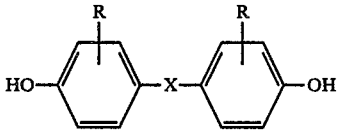

wherein X represents S, O, $SO_2$, $S_2$, or

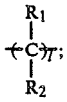

l represents an integer of 0 to 3; $R_1$ and $R_2$ each represents a hydrogen atom or a $C_{1-8}$ alkyl group or $R_1$ and $R_2$ are bonded to each other to form a cycloalkyl group; and R represents a $C_{1-8}$ straight chain or branched alkyl group or halogen atom;

(V)

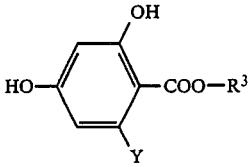

wherein Y represents a hydrogen atom, $-CH_3$ or $-OH$; $R_3$ represents

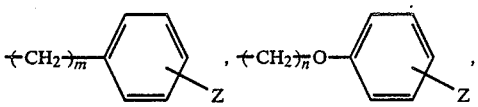

or a $C_{1-6}$ straight chain or branched alkyl group; m and n each represent an integer of 0 to 3; Z represents a hydrogen or halogen atom or $-CH_3$;

(VI)

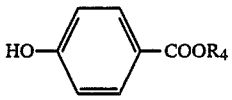

wherein $R_4$ represents a benzyl group, a halogen atom, a $C_{1-8}$ straight chain or branched alkyl group substituted by a benzyl group or a $C_{1-8}$ straight chain or branched alkyl group;

(VII)

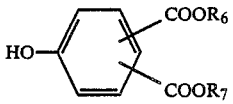

wherein $R_6$ and $R_7$ each represent a $C_{1-8}$ alkyl group;

(VIII)

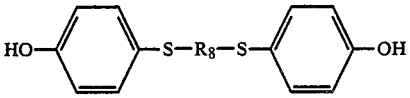

wherein $R_8$ represents an alkyl group having 1 to 5 ether bonds.

Preferred examples of the present electron accepting compounds other than those represented by general formulae (IV) to (VIII) include bis-hydroxy cumylbenzenes and bis-hydroxy-α-methylbenxyl benzenes Specific examples of these benzenes include 1,4-bis-p-hydroxy cumylbenzene, 1,4-bis-m-hydroxy cumylbenzene, 1,3-bis-p-hydroxy cumylbenzene, 1,3-bis-m-hydroxy cumylbenzene, 1,4-bis-o-hydroxy cumylbenzene, 1,4-bis-p-hydroxy-α-methylbenzylbenzene, 1,3-bis-p-hydroxy-α-methylbenzylbenzene, etc. Preferred examples of the present electron accepting compounds also include salicylic acid derivatives such a 3,5-di-α-methylbenzyl salicylic acid, 3,5-di-α-tertiary butyl salicylic acid, 3-α,α-dimenthylbenzyl salicylic acid, and polyvalent metal salts thereof (particularly preferred metals are zinc and aluminum) and phenols such as p-phenylphenol and 3,5-diphenylphenol cumylphenol. However, the present electron accepting compounds are not limited to these compounds.

The above-mentioned electron accepting compound preferably comprises about 50 to about 1,000% by weight of an electron donating dye precursor. The more preferred content of such an electron donating dye precursor is 100 to 500% by weight. Such electron donating dye precursors may be used singly or in admixture of two or more kinds.

If the dye precursor is a diazo compound, a coupling component which forms a dye upon coupling with the diazo compound (diazonium salt) in a basic atmosphere may be used. Specific examples of such a compound include resorcin, fluoroglycin, 2,3-dihydroxynaphthalene-6-sodium sulfonate, 1-hydroxy-2-morpholinopropyl amide naphthoate, 1,5-dihydroxynaphthalene, 2,3-dihydroxynaphthalene, 2,3-dihydroxy-6-sulfonylnaphthalene, 2-hydroxy-3-morpholinopropyl amide naphthoate, 2-hydroxy-3-anilide naphthoate, 2-hydroxy-3-naphthoic acid-2-methylanilde, 2-hydroxy-3-ethanol amide naphthoate, 2-hydroxy-3-octyl amide naphthoate, 2-hydroxy-3-naphthoic acid-N-dodecyl-oxo-propyl amide, 2-hydroxy-3-tetradecyl amide naphthoate, acetoanilide, acetoacetoanilide,benzoylacetoanilide, 1-phenyl-3-methyl-5-pyrazolone, 1-(2', 4', 6'-trichlorophenyl)-3-benzamide-5-pyrazolone, 1-(2', 4', 6'-trichlorophenyl)-3-anilino-5-pyrazolone, 1-phenyl-3-phenylacetoamide-5-pyrazolone, etc. These coupling components may be used in combination so that an image of a desired tone can be obtained.

An assistant coloring agent may also be used. For example, a basic substance which is insoluble or sparingly soluble in water or a substance which produces an alkali when heated may be employed.

Examples of such assistant coloring agents include nitrogen-containing compounds such as inorganic and organic ammonium salts, organic amine, amide, urea and thiourea and derivatives thereof, thiazole, pyrrole, pyrimidine, piperazine, guanidine, indole, imidazole, imidazoline, trizole, morpholine, piperidine, amidine, formadine, and pyridine, etc.

The present heat-sensitive recording material may further contain a heat-fusible substance in the heat-sensitive coloring layer in order to improve its heat response.

Specific examples of such a heat-fusible substance include p-benzyloxy benzyl benzoate, β-naphthyl benzyl ether, stearic acid amide, amide palmitate, N-phenyl stearic acid amide, N-stearyl urea, phenyl ester β-naphthoate, 1-hydroxy-2-phenyl ester naphthoate, β-naphthol (p-chlorobenzyl) ether, β-naphthol (p-methylbenzyl) ether, α-naphthyl benzyl ether, 1,4-butanediol-p-methyl phenyl ether, 1,4-propanediol-p-methyl phenyl ether, 1,4-butanediol-p-isopropyl phenyl ether, 1,4-butanediol-p-t-octyl phenyl ether, 2-phenoxy-1-p-tolyloxy-ethane, 1-phenoxy-2-(4-ethylphenoxy) ethane, 1-phenoxy-2-(4-chlorophenoxy) ethane, and 1,4-butanediol phenyl ether, etc.

These heat-fusible substances may be used singly or in admixture thereof. In order to provide a sufficient heat response, the present heat-fusible substance is preferably used in an amount of about 10 to about 20%, more preferably 20 to 150%, by weight based on the weight of the electron accepting compound.

Conventional binary heat-sensitive recording materials comprising an electron donating dye precursor and an electron accepting compound are generally subject to discoloration of produced recorded images due to external conditions such as moisture and heat.

Thus, the present heat-sensitive recording material preferably contains in its heat-sensitive coloring layer a compound which prevents discoloration and renders produced images fast to such external conditions.

Anti-discoloration agents which may be used include a phenol derivative; particularly effectively used is a hindered phenol compound.

Such a phenol compound is preferably used in an amount of about 1 to about 200%, more preferably 5 to 50%, by weight based on the weight of the electron accepting compound.

The heat-sensitive coloring layer of the present heat-sensitive recording material generally comprises a polymer as a binder. As such a polymer there may be used a compound which can be dissolved in water at 25° C. in an amount of about 5% or more by weight. Specific examples of such a compound include methyl cellulose, carboxy methyl cellulose, hydroxy ethyl cellulose, starch gelatin, gum arabic, casein, a hydrolyzed product of styrene-maleic anhydride copolymer, a hydrolyzed product of ethylene-maleic anhydride copolymer, a hydrolyzed product of isobutylene-maleic anhydride copolymer, polyvinyl alcohol, carboxy denatured polyvinyl alcohol, and polyacryl amide, etc.

The heat-sensitive coloring layer of the present heat-sensitive recording material optionally comprises a pigment, a water-insoluble binder, a metal soap, a wax, a surface active agent, and the like.

Pigments which may be used include zinc oxide, calcium carbonate, barium sulfate, titanium oxide, lithopone, talc, agalmatolite, kaolin, aluminum hydroxide, silica, amorphous silica, etc.

Water-insoluble binders which may be generally used include a synthetic rubber latex or a synthetic resin emulsion. Specific examples are a styrene-butadiene rubber latex, a acrylonitrilebutadiene rubber latex, a methyl acrylate-butadiene rubber latex, a vinyl acetate emulsion, etc.

A metal soap which may be used is a higher aliphatic acid metal salt. Examples of such a higher aliphatic acid metal salt include emulsions of zinc searate, calcium stearate, aluminum stearate, etc.

A wax is used in the form of an emulsion. Examples of wax which may be used in the present invention include paraffin wax, microcrystalline wax, carnauba wax, methylol stearamide, polyethylene wax, and polystyrene wax, etc.

Examples of surface active agents which may be used in the present invention include sulfosuccinic alkali metal salts, fluorine-containing surface active agents, etc.

In the present invention, the protective layer further comprises a pigment, a metal soap, a wax, or the like in order to improve its capability of matching to the thermal head upon printing and its water resistance.

The amount of such a pigment to be added is preferably about 0.5 to about 4 times, particularly preferably 0.8 to 3.5 times the total weight of the above polymer as the binder. If the added amount of the pigment is less than the lower limit recited above of 0.5, the heat-sensitive recording material's capability of matching to the head cannot be effectively improved. On the other hand, if the added amount of the pigment is higher than the upper limit recited above, the sensitivity becomes remarkably low, marring the commercial value. Examples of pigments which may be used in the present invention include zinc oxide, calcium carbonate, barium sulfate, titanium oxide, lithopone, talc, agalmatolite, kaolin, aluminum hydroxide, silica, amorphous silica, colloidal silica, etc.

A metal soap which may be used is a higher aliphatic acid metal salt in the form of an emulsion. Examples of such a higher aliphatic acid metal salt include zinc stearate, calcium stearate, aluminum stearate, etc. Particularly preferred is zinc stearate. The amount of such a metal soap to be added is preferably about 0.5 to about 20%, particularly preferably 1 to 10% by weight based on the total weight of the protective layer. Examples of wax which may be used in the present invention include paraffin wax, microcrystalline wax, carnauba wax, methylol stearamide, amide stearate, polyethylene wax, polystyrene wax, etc. These waxes are used in the form of an emulsion. The amount of the wax to be added is preferably about 1 to about 20%, particularly preferably 1 to 10% by weight based on the total weight of the protective layer.

The protective layer material may further comprise a surface active agent in order to provide a uniform protective layer when applied to the heat-sensitive coloring layer. Examples of such a surface active agent which may be used in the present invention include sulfosuccinic alkali metal salts, fluorine-containing surface active agents etc. Specific examples of such a surface active agent include sodium salts or ammonium salts of di-(2-ethylhexyl) sulfosuccinic acid and di-(n-hexyl)sulfosuccinic acid, etc. Almost all anionic surface active agents may be effectively used.

The amount of the protective layer of the present invention to be applied is preferably 0.5 to 10 g/$^2$, more preferably 1 to 5 g/m$^2$.

Supports which may be used in the present invention include papers (e.g., a fine paper, a neutralized paper, a coated paper, etc.), synthetic papers, plastic films, etc.

The present invention will be further illustrated in the following examples, but the present invention should not be construed as being limited thereto. Unless otherwise indicated herein all parts, percents ratios and the like are by weight.

EXAMPLE 1

20 g of crystal violet lactone, 20 g of parahydroxy benzyl benzoate, 20 g of amide stearate, and 20 g of 1,1,3-tris(2-methyl-4-hydroxy-tert-butylphenyl)butane were each subjected to dispersion with 100 g of a 5% aqueous solution of polyvinyl alcohol (PVA) 105, trade name; product of Kuraray Co., Ltd.) overnight by means of a ball mill so that the volume average particle diameter became 3$\mu$ or less. 80 g of a pigment was dispersed in 160 g of a 0.5% solution of sodium hexametaphosphate by means of a homogenizer. The dispersions thus prepared were mixed in a mixing proportion of 5 g of crystal violet lactone dispersion, 10 g of parahydroxy benzyl benzoate dispersion, 5 g of amide stearate dispersion, 2 g of 1,1,3-tris(2-methyl-4-hydroxy-5-tert-butylphenyl)butane dispersion, and 22 g of pigment dispersion. Furthermore, 3 g of a 21% emulsion of zinc stearate and 5 g of a 2% aqeuous solution of di(2-ethylhexyl) sodium sulfosuccinate were added to the admixture to obtain a coating solution (hereinafter referred to as "M Solution"). M Solution thus obtained was applied to the surface of a fine paper of a weighed amount of 60 g/m$^2$ by means of a wire bar in such a manner that the dried amount was 5 g/m$^2$. The coat was then dried in a 50° C. oven to obtain a heat-sensitive coloring layer.

A coating solution 1 prepared by the process described below was applied to the surface of the heat-sensitive coloring layer thus obtained in such a manner that the coated amount was 3.0 g/m$^2$ in terms of solid content. The coat was dried at a temperature of 50° C. for 2 minutes. Furthermore, a coating solution 2 prepared by the process described below was applied to the coat thus obtained and then dried in the same manner as above to obtain a heat-sensitive recording paper of the present invention.

PREPARATION OF COATING SOLUTIONS FOR PROTECTIVE LAYER

Coating solution 1

| | |
|---|---|
| 8% aqueous solution of polyvinyl alcohol[a] ([a]Saponification degree: 95% or more; polymerization degree: about 2,400; PVA 124, trade name: product of Kurarey Co., Ltd.) | 94 g |
| 4% 2,3-dihydroxy-5-methyl-1,4-dioxane | 9.4 g |

The above components were mixed to prepare a protective layer coating solution 1.

Coating Solution 2

| | |
|---|---|
| Aqueous solution of silicon-containing denaturated polyvinyl alcohol[b] ([b]Copolymer of vinyl trimethoxy silane and vinyl acetate; content of silicon in terms of the amount of vinyl silane unit: 0.5 mol. %; saponification degree of vinyl acetate unit: 98.3%; polymerization degree of vinyl acetate: about 500; solid content: 10%; R-2105, trade name: product of Kurarey Co., Ltd.) | 20 g |
| 10% colloidal silica (Snow Tex S, trade name: product of Nissan Chemicals Co., Ltd. | 36 g |

These components were mixed to prepare a protective layer coating solution 2.

EXAMPLE 2

A heat-sensitive recording paper was prepared in the same manner as used in Example 1 except in that the protective layer coating solution 2 was prepared as follows:

| | |
|---|---|
| 10% aqueous solution of silicon-containing denaturated PVA[c] ([c]same as used in Example 1) | 16.5 g |
| Water | 24.0 g |
| 2% aqueous solution of 2-ethylhexyl sodium sulfosuccinate | 0.3 g |
| 40% dispersion of kaolin (Kaobrite; Georgia Pacific Co., Ltd.) | 3.5 g |
| 30% dispersion of zinc stearate | 0.6 g |
| 30% colloidal silica (Snow Tex S, trade name: Nissan Chemicals Co., Ltd.) | 9.8 g |

These components were mixed to prepare a proteactive layer coating solution 2.

EXAMPLE 3

A heat-sensitive recording paper was prepared in the same manner as used in Example 1 except in that the protective layer coating solution 2 was prepared as follows:

| | |
|---|---|
| Aqueous solution of silicon-containing denaturated polyvinyl alcohol[d] ([d]Copolymer of vinyl trimethoxy silane and vinyl acetate; content of silicon in terms of amount of vinyl silane | 20 g |

-continued

| | |
|---|---|
| unit: 0.5 mol. %; saponification degree of vinyl acetate unit: 98.5%; polymerization degree: about 1,000) | |
| 10% colloidal silica (Snow Tex S, trade name: Nissan Chemicals Co., Ltd.) | 24 g |

These components were mixed to prepare a protective layer coating solution 2.

EXAMPLE 4

A heat-sensitive recording paper was prepared in the same manner as used in Example 1 except in that the protective layer, coating solution 1 was prepared as follows:

| | |
|---|---|
| 8% aqueous solution of polyvinyl alcohol[(a)] ([(a)]same as in Example 1) | 20 g |

A protective layer coating solution 1 was prepared from the above component

EXAMPLE 5

A heat-sensitive recording paper was prepared in the same manner as used in Example 1 except in that the heat-sensitive coloring layer, a coating solution was prepared as follows:

| | |
|---|---|
| M Solution | 26.8 g |
| 47% styrene butadiene rubber latex emulsion (Polylac 752 A, trade name: Mitsui Toatsu Chemicals Inc.) | 3.3 g |
| 10% aqueous solution of polyvinyl alcohol (PVA-117, trade name: Kuraray Co., Ltd.) | 15.8 g |
| 4% 2,3-dihydroxy-5-methyl-1,4-dioxane | 3.9 g |
| Water | 12.4 g |

COMPARATIVE EXAMPLE 1

A heat-sensitive recording paper for comparison was prepared in the same manner as used in Example 1 except in that no protective layers were provided.

COMPARATIVE EXAMPLE 2

A heat-sensitive recording paper for comparison was prepared in the same manner as used in Example 1 except in that a single protective layer was provided by using the coating solution 2 alone without using the coating solution 1.

COMPARATIVE EXAMPLE 3

A heat-sensitive recording paper for comparison was prepared in the same manner as used in Example 1 except in that a single protective layer was provided by using the coating solution 1 alone without using the protective layer coating solution 2.

COMPARATIVE EXAMPLE 4

A heat-sensitive recording paper for comparison was prepared in the same manner as used in Example 1 except in that a double protective layer was provided by applying the protective layer coating solution 2 alone twice to the surface of a heat-sensitive coloring layer.

The heat-sensitive recording papers obtained in Examples 1 to 5 and Comparative Examples 1 to 4 were subjected to coloring by means of a label printer TEC-H9606 (trade name: product of Tokyo Electric Co., Ltd.) The heat-sensitive recording papers thus colored were then examined for resistance to water, oil and chemicals.

As apparent from Table 1, the heat-sensitive recording papers having as a protective layer a lamination of a layer of polyvinyl alcohol and a layer of silicon-containing denaturated polyvinyl alcohol have improved resistance to oil and water.

TABLE 1

| | Resistance to solvents and results of sticking and blocking tests | | | | | | | |
|---|---|---|---|---|---|---|---|---|
| | Water resistance | | Resistance to ethanol* (40% aqueous solution) | Resistance to cooking oil* (rape oil) | Resistance to fat* (beef) | Resistance to plasticizer* (dibutyl phthalate) | Sticking | Blocking |
| | A* | B* | | | | | | |
| Example | | | | | | | | |
| 1 | o | o | o | o | o | o | Δ | Δ |
| 2 | o | Δ | o | o | o | o | o | o |
| 3 | o | o | o | o | o | o | o | o |
| 4 | o | Δ | o | o | o | o | o | o |
| 5 | o | o | o | o | o | o | o | o |
| Comparative Example | | | | | | | | |
| 1 | x | x | x | x | x | x | Δ | Δ |
| 2 | Δ | Δ | Δ | x | x | x | Δ | Δ |
| 3 | x | x | x | Δ | Δ | Δ | Δ | Δ |
| 4 | Δ | Δ | Δ | x | x | x | Δ | Δ |

o: Excellent
Δ: Slightly poor but gives no practical problem
x: Not suitable for practical use
A*: Rubbed with an applicator impregnated with water by 20 round trips
B*: Examined when dried after being soaked in water for 16 hours
*Examined after being allowed to stand for 24 hours with each solvent applied (The application of the solvent was made by an applicator.)

While the invention has been described in detail and with reference to specific embodiments thereof, it will be apparent to one skilled in the art that various changes and modifications can be made therein without departing from the spirit and scope thereof.

What is claimed is:

1. A heat-sensitive recording material comprising a support having provided thereon a heat-sensitive coloring layer containing an electron donating dye precursor which is normally colorless or light-colored and an electron accepting compound which exhibits a color upon reaction with said dye precursor, wherein said coloring layers is laminated with a first protective layer containing a polyvinyl alcohol resin and a second protective layer containing a silicon-containing denaturated polyvinyl alcohol and a colloidal silica and/or amorphous silica; either said first or second protective layer may be coated directly on said coloring layer.

2. A heat-sensitive recording material as claimed in claim 1, wherein the polymerization degree of said polyvinyl alcohol resin in said first protective layer is about 1,000 or more, and the saponification degree is about 86% or more.

3. A heat-sensitive recording material as claimed in claim 1, wherein said first protective layer further comprises other polymers.

4. A heat-sensitive recording material as claimed in claim 1, wherein said silicon-containing denaturated polyvinyl alcohol contains a reactive substituent group selected from the group consisting of an alkoxyl group, an acyloxyl group, a hydoxyl group or an alkali metal salt thereof.

5. A heat-sensitive recording material as claimed in claim 1, wherein said silicon-containing denaturated polyvinyl alcohol is the reaction product of vinyl acetate and silicon atom-containing olefinic unsaturated monomers.

6. A heat-sensitive recording materials as claimed in claim 1, wherein the silicon atom content of said silicon-containing denaturated polyvinyl alcohol is from about 0.01 to about 10 mol%.

7. A heat-sensitive recording material as claimed in claim 1 , wherein said colloidal silica is a colloid solution comprising ultra-fine silicic anhydride dispersed in water and said silicic anhydride has a particle size of about 10 to about 100 $\mu$m.

8. A heat-sensitive recording material as claimed in claim 7, wherein the pH of said colloid solution is about 4 to about 10.

9. A heat-sensitive recording material as claimed in claim 1, wherein said dye precursor compound is an electron accepting compound selected from the group consisting of tiarylmethane compounds, diphenylmethane compounds, xanthane compounds, thiazine compounds, spiropyrane compounds and diazo compounds.

* * * * *